US006472013B2

(12) United States Patent
Graczyk

(10) Patent No.: US 6,472,013 B2
(45) Date of Patent: Oct. 29, 2002

(54) RECORDING INK JET PAPER WITH IMPROVED DIMENSIONAL STABILITY

(75) Inventor: Tomasz Graczyk, Branford, CT (US)

(73) Assignee: Oce-Imaging Supplies, Guilford, CT (US)

( * ) Notice: Subject to any disclaimer, the term of this patent is extended or adjusted under 35 U.S.C. 154(b) by 0 days.

(21) Appl. No.: 09/797,706

(22) Filed: Mar. 5, 2001

(65) Prior Publication Data

US 2001/0014370 A1 Aug. 16, 2001

Related U.S. Application Data

(62) Division of application No. 09/104,191, filed on Jun. 25, 1998, now abandoned.

(51) Int. Cl.[7] ..... B41M 5/00
(52) U.S. Cl. ..... 427/152; 428/195
(58) Field of Search ..... 428/195, 211, 428/500, 522, 331, 532, 537.7; 427/152

(56) References Cited

U.S. PATENT DOCUMENTS 4,853,255 A 8/1989 Onishi et al. ..... 427/148
5,277,965 A 1/1994 Malhotra ..... 428/216
5,330,824 A 7/1994 Takimoto et al. ..... 428/195
5,352,503 A * 10/1994 Drake et al. ..... 428/195
5,356,464 A 10/1994 Hickman et al. ..... 106/31.36
5,501,902 A 3/1996 Kronzer ..... 428/323
5,521,002 A 5/1996 Sneed ..... 428/331
5,579,693 A 12/1996 Carreira et al. ..... 101/424.1
5,589,034 A 12/1996 Hultman et al. ..... 162/111
5,589,269 A 12/1996 Ali et al. ..... 428/411.1
5,888,635 A 3/1999 Yang et al. ..... 428/212

* cited by examiner

*Primary Examiner*—Bruce H. Hess
(74) *Attorney, Agent, or Firm*—Birch, Stewart, Kolasch & Birch, LLP

(57) ABSTRACT

A multicolor ink jet recording paper with improved dimensional stability for wide format printing is achieved by applying to at least one side of a paper support a dimensional stability improving layer containing polyethylene oxide polymer or copolymer. A suitable ink receptive layer is applied to the thus coated paper. The dimensional stability layer can be applied on the opposite side of the support as the ink receptive layer or as an underlayer of the ink receptive layer, and can be applied on both sides of the paper support. The ink jet recording paper possesses a short dry time, provides superior image quality, and is free of print defects typical in wide format paper bond printing.

5 Claims, No Drawings

RECORDING INK JET PAPER WITH IMPROVED DIMENSIONAL STABILITY

This application is a divisional of application Ser. No. 09/104,191, now abandoned, filed on Jun. 25, 1998, the entire contents of which are hereby incorporated by reference and for which priority is claimed under 35 U.S.C. § 120.

FIELD OF INVENTION

The present invention relates to multicolor ink jet recording. More particularly, it relates to ink-receptive materials having improved dimensional stability for use in wide format multicolor printing.

BACKGROUND OF THE INVENTION

The rapid growth of computers and their many and varied applications continue unabated. Multicolor ink jet printing has benefited from this growth aided by the low cost of color printers and improved quality of the recording media. The cost of color printers has become so low that they have become the preferred printing mode for home computer use.

The commercial market for ink jet color printing has likewise grown in such applications as presentation and computer-aided drafting. Contributing to this growth have been improvements in ink-receptive recording materials with regard to image density, feathering resistance, color brightness, color-to-color edge sharpness and water resistance. The graphic arts market, however, with its huge growth possibilities has yet to realize its potential, mainly because of its more demanding quality requirements. These include color brilliance and fidelity, freedom from surface dusting and color rub-off, instantaneous dry times and more consistent quality over the wide range of humidities normally encountered during printing. As often happens, one set of qualities can be obtained only at the expense of another, thereby making it difficult to obtain all of the requisite qualities.

The absorption of water into and desorption out of paper has produced some undesirable side effects in ink jet printing, such as strike through, paper cockles and paper curl. Paper curl is a function of the amount of aqueous liquid deposited on the recording medium. More printing on a page or the use of higher volumes of inks per unit area increases curl potential.

Depositing aqueous inks on paper causes an initial hydroexpansion of the fibers of the paper. This initial hydroexpansion causes an expansion curl away from the image which occurs typically right after printing. Steady state curl is toward the image, and typically occurs over a period of the time when the sheet tries to achieve a state of final stress release after being dried. Excessive drying in the process of coating accelerates steady state curl toward the image.

The amount of time that it takes for a sheet of paper to reach steady state depends on the type and the amount of the ink being used. Penetrants in the ink change the depth of its penetration and thus modify the amount of time taken to reach steady state curl. A co-solvent humectant such as ethylene glycol serves to keep a paper essentially flat. For example, ethylene glycol appears to produce a long term hydroexpansion that reduces or counteracts the stress relaxation of the sheet. This effect, however, is lost over time to produce a final curl toward the image.

Stiffness is an extremely important property for many paper products. It is one of the most important mechanical properties of paperboard used for packaging. On the other hand, there are a number of papers where a lack of stiffness is an important property. Tissue, toweling, and napkins all must be soft and pliable, which is just opposite of stiffness. Labels must often conform to a non flat surface in use, and a high stiffness would make this difficult.

The stiffness of paper is dependent on a number of factors. The most important are: thicknesses, the Young's modules of the paper, the amount of restraint applied during drying, moisture and surface treatment. Paper machine direction stiffness increases if additional tension on the web is applied during drying. A three-fold increase in the Young's modules occurs in going from zero restraint to high restraint. The paper moisture influences its Young's modules and consequence stiffness. For example, the Young's modules of a paper can be reduced by 50% in going from 22% to 85% relative humidity.

The hydroexpansion of paper is dependent on a paper sheet furnish. By changing the ratio of hardwood to softwood it is possible to achieve a paper with reduced curl, and minimal hydroexpansion. However, the end user has only a limited possibility to modify properties of already made paper.

Graphic art media designed for wide format color ink jet printers should give high quality images and, at the same time, have the capability to absorb high amounts of inks. In Hewlett Packard printers, such as HP 650, HP 750 and HP 2000 series printers, the printed edge is passed through a supporting drum and is held by a frame. The feeding and printing system keeps the media firmly in place and prevents paper surface distortion during printing. In Nova Jet printers, recording media are fed from the back and the printed edge falls down freely after printing. The differences obtained with both systems is hardly observable, for media such as vinyl, backlit film, and photobase. Photobase has a layer of extruded polyethylene on the surface. This layer prevents any paper surface distortion during printing. When paper bond is printed on EnCad printers the edge of the sheet does not band following the shape of printer feed plate but is nearly horizontal due to paper stiffness. At some moment of printing the edge falls abruptly, which creates head strike on the paper in the form of smearing and so called "horseshoes". The problem is more severe for heavy weight papers (a high caliper) than for lightweight ones.

There is no paper base on the market suitable for absorbing a high amount of inks applied in wide format printing such as EnCad without paper surface distortion. The ink jet receiving layer improves the absorption ability of paper but on the other hand increases its stiffness.

It is well known that dimensional stable paper can be achieved by applying a liquid (i.e., water) impermeable coating to both sides of a base paper. Although the paper becomes impermeable to ink particularly to water and glycol based inks, curling due to shrinking and swelling of the functional coating still occurs. Moreover, the addition of this layer may greatly reduce the receptive ability for aqueous inks, which is seen in the form of a longer dry time that becomes similar to that of photobase. Furthermore, the hydrophobing surface layer of pretreated paper has low affinity to hydrophilic ink receiving layers. Consequently, such receiving layers have a tendency of flaking, peeling and very often have a low resistance to folding.

A paper recording medium should remain flat over a wide range of humidities both during and after printing. This ability to remain flat is especially important when the humidity in the surrounding environment changes.

It is known that curls of paper can be reduced or eliminated by the addition of a second coating to the backside of the recording sheet to balance the differential hydroexpansivity of paper. This coating is applied to counteract any shrinkage or swelling resulting from the ink jet receiving top coating. However, a backside layer may not reduce the curl to the desired extent in cases where precise amounts of the two coatings are needed. Suited compositions for such back-coating layers are well known to those skilled in the art. They may generally include the same coating as the top coat, e.g., polyvinyl alcohol, which is fully or partially hydrolyzed, various starches or carboxymethylcellulose. Although commonly used polymers can compensate curl relatively well, they make the paper stiffer. Further, the type of chemicals used in producing an anti-curl layer and a method of coating has to be selected with great caution to prevent deterioration of ink jet layer print quality.

In U.S. Pat. No. 4,853,255 to Onishi et al., a process for controlling curl in a web of coated paper is described. A paper web is unwound from a reel and coated with a coating composition applied to one side of the web. Water is applied to the opposite side of the coated paper to thereby control curl resulting from the coating composition previously applied.

U.S. Pat. No. 5,277,965 to Malhotra, describes a recording sheet which includes, in the order stated, an ink receiving layer, a base sheet, a heat absorbing layer, and an anticurl layer. The recording sheet can be a transparent or opaque polymer, and can be used in a wide variety of printing and imaging processes. The recording sheet exhibits little or no curling, even after exposure to heat and/or a wide range of relative humidities. The anticurl and ink receiving layers comprise binary and ternary blends of poly(ethylene oxide) with a variety of polymers in broad range of ratios.

U.S. Pat. No. 5,330,824 to Takimoto et al discloses an image protecting film useful for protecting an image recorded on a porous recording medium by an ink jet recording system comprising a layer composed mainly of a polyester resin formed on the support, said polyester resin being a copolymer comprising aliphatic dicarboxylic acid units, aromatic dicarboxylic acid units and aliphatic polyol units.

U.S. Pat. No. 5,501,902 to Krozner et al discloses an ink jet printable heat transfer material having first and second surfaces, which printable material includes a first layer defining the first surface and a second layer defining the second surface. The second layer includes particles of a thermoplastic polymer and about 1 to about 20 weight percent of humectant consisting of ethylene glycol and polyethylene glycol.

U.S. Pat. No. 5,521,002 to Sneed et al discloses an ink jet receptive matte coating composition comprising one or more hydrophilic, water soluble polymers, a hydrophobic cellulose ether polymer, a polyalkylene glycol and a filler or pigment for making the layer opaque. The formula is coated on a transparent, translucent, or opaque base support, such as a polyester film, onto which a matte, opaque ink receptive layer is applied on at least one side. The ink receiving media allows for a quick drying of ink jet printing inks while controlling the edge sharpness of the printed areas and is resistant to moisture and humidity effects.

U.S. Pat. No. 5,579,693 to Carriera et al discloses a method and apparatus for controlling curl in a liquid ink printer. The liquid ink printer deposits an anticurl material on the side of a sheet that is opposite the side having printing deposited thereon. The anticurl material is a fluid, which counteracts the steady state curl in the direction of the printed image resulting from active drying of the printed sheet. The back side of a printed sheet has deposited thereon an anticurl fluid which can contain water, a penetrant, and a humectant like material such as diethylene glycol, ethylene glycol, sulfolate and glycerin.

U.S. Pat. No. 5,589,034 to Hultman et al discloses the use of polyhydric alcohol and polyethylene glycol in a polymer-reinforced paper having improved cross-directional tear, particularly when the paper has a moisture content no greater than about 5 percent by weight.

The effect of polyethylene oxide copolymers on paper ink jet media has been described in several patents. There are two approaches to eliminate, or if that is not possible, significantly reduce a curl, which are (1) an addition of anticurl additives to an ink or (2) an addition of similar groups of chemicals to an ink receiving layer.

U.S. Pat. No. 5,352,503 to Drake et al discloses a recording paper that is useful in an ink jet recording process. The recording paper comprises a substrate and a coating. The binder of the coating contains a water-soluble polymer, such as a polyvinyl alcohol, and a curl behavior enhancing amount of a polyether, e.g., a polyalkylene glycol such as polyethylene glycol.

U.S. Pat. No. 5,356,464 to Hickman et al discloses aqueous ink compositions containing ant-curl agents, mostly polyethylene glycols, which substantially reduce or eliminate paper curl in plain paper printed elements without adversely effecting storage stability, decap properties or print quality, and thus eliminate the need for expensive and bulky mechanical curl-arresting devices or special curl-resistant substrates.

The above-mentioned systems composed of adding polyalkylene glycols anticurl additives to ink receiving layers or to inks do not provide sufficient dimension stability in wide format ink jet printing. At high humidity, the quality of prints deteriorates in the form of bleeding, feathering, reduced resolution and long dry time. There is a continuous need for new paper media with significant ink absorption and good dimensional stability (i.e., curl, cockle and wrinkle free), which is economically and easily manufactured. The present invention eliminates these deficiencies and provides ink receiving material with excellent print quality and dimension stability for wide format printing.

SUMMARY OF THE INVENTION

A main object of this invention is to provide improved dimensional stability to a paper sheet to meet the more demanding requirements of ink jet multicolor printing applications. It is a further object of the invention to provide a low cost and environmentally favorable means of manufacturing ink jet media using aqueous-based coating formulations.

Accordingly, the present invention provides a multicolor ink jet recording material comprising a paper support having directly coated on at least one side thereof a dimensional stability improving layer, which layer contains a polyalkylene oxide, and an ink receptive surface layer that is coated on the opposite side of the support as the dimensional stability improving layer, or alternatively, which is coated on the same side of the support as the dimensional stability improving layer.

The recording material according to the invention is advantageous with regard to the print quality of produced images and that they are without defects frequently encountered in wide format printing on a paper substrate. Unexpectedly, it was found that the incorporation of a polyalkylene oxide, such as polyethylene oxide polymers and copolymers, in a dimensional stability improving layer eliminates print defects such as smearing and "horseshoes" and enhances color brilliance and provides better color fidelity to the recorded images.

Preferably the dimensional stability improving layer is present on the side of the support opposite to the side bearing the ink receptive surface layer. However, optionally, the dimensionally stability improving layer may be applied as an underlayer just below the ink receptive surface layer on the same side of the support. Also, optionally, in the most severe cases, a dimensional stability improving layer may be applied directly to both sides of the support.

When the dimensional stability improving layer is present on the side of the support that is opposite to the side that bears the ink receiving layer, best print quality, in particular under conditions of higher temperature and humidity, is obtained when the dimensional stability improving layer is coated onto the support before the application of the ink receiving layer.

DESCRIPTION OF THE INVENTION

The recording material of the invention comprises a cellulosic base support, i.e., a paper support, over which resides (1) an ink receptive surface layer of any suitable composition as is known per se in the art (e.g., such compositions generally comprise a polymeric binder, an ink absorptive pigment, a cationically modified polymer or copolymer) and (2) a dimensionally stability improving layer, which contains a polyalkylene oxide polymer and/or copolymer. The dimensional stability improving layer may be applied to the opposite side of the cellulosic support as the ink receptive surface layer, as an underlayer underneath the ink receptive surface layer, or to both sides of the cellulosic support.

The recording material provides prints having dense bright colors, sharp color-to color boundaries, freedom from feathering, water bleed resistance, clean and bright backgrounds, uniform color fill and good image resolution. Furthermore, the material is free of defects such as head streaks, smearing and "horseshoes" occurring frequently during printing paper bonds on large format printers.

While polyalkylene oxide (co)polymers may have heretofore been known as substances used in compositions for controlling paper curl, the use of polyethylene oxide copolymers to prepare dimensional stability improving compositions for support papers was not, however, known heretofore, and the provision thereof was not obvious. This is because their use in a paper back coating has to be done with caution due to the possibility of negative effects on ink jet print quality. For example, most polyalkylene oxide copolymers cannot give dimension stable paper sheets without cockle, head strikes, smearing and puckering and, at the same time, provide prints with excellent quality. Thus, while a paper can be flat after applying a back coat of polyalkylene oxide polymers, thereafter in most cases during printing, where a high amount of aqueous inks is applied, the paper will cockle and wrinkle and the printed image will show prints' defects such as head strikes, smearing, "horse shoes", etc.

Further, the sequence of coating has an effect on final print quality. If the dimensional stability improving composition is applied on the opposite side of paper after the ink jet receiving layer, the resulting prints show defects such as mottle and bleed.

In contrast, in the present invention, the dimensional stability improving layer is applied to a cellulose support first and an ink receiving layer is applied second, to thereby obtain a combination of both excellent print quality and dimensional stability. The dimensional stability improving composition in the ink jet recording material according to the invention can be also applied as underlayer just below the ink receiving layer, if so desired.

The dimensional stability improving layer of the present invention comprises as a main constituent at least one polyalkylene oxide polymer or copolymer. The layer may also contain one or more water-soluble and/or water-dispersible polymers. Suitable examples of such water soluble polymers include polyvinyl alcohol, modified polyvinyl alcohol (carboxyl-modified PVA, sulfonic-modified PVA, acrylamide-modified PVA, cationic modified PVA, long chain alkyl-modified-PVA, silicon-modified PVA), starch modified starch, etherified starch, oxidized starch, casein, sodium alginate, gelatin, chemically modified gelatin, gum arabic, cellulose derivatives, oxidized cellulose, methylcellulose, hydroxy-ethylcellulose, carboxymethyl-cellulose, poly(vinyl pyrrolidone), vinyl pyrrolidone copolymers, poly(ethylene oxide). Water dispersible resins (synthetic resin emulsion) includes such as polyacrylates, polymethacrylates, polyvinyl acetate, polyvinyl chloride, styrene, styrene and maleic acid anhydride copolymers. The amount of such additives should not be greater than 50% by weight and preferably ranges between 10 and 30% by weight.

In addition to the above-mentioned components, different additives may be utilized in the inventive formulations to give desired properties to the produced ink jet recording media. These additives include surfactants, defoamers, UV-absorbents, and the like. Various coating methods are employed in the manufacture of imaging materials. These include Meyer rod, air knife, reverse roll and extrusion coatings. The Meyer rod method is preferred because of the ease of its use. Thus, the relatively low and consistent viscosity of the coating formulation is of particular advantage. The dry coating weight of the dimensional stability improving layer is in the range of about 2–30 g/m$^2$, and the preferable weight is about 2.0 g/m$^2$ to about 10 g/m$^2$, since layer coating weights may result in reduced print quality such as bleed, smearing, "horseshoes" and penetration through on the other side.

The resulting multicolor ink jet recording media is imaged by EnCad Nova Jet Pro and PROe ink jet printers, or their equivalents, with aqueous or pigmented color inks to provide dense bright colors, sharp color to color boundaries, freedom from feathering, clean and bright backgrounds, water bleed-resistance, uniform color fill and good image resolution.

The invention is hereafter described with reference to the following specific examples and comparative examples. The weight is in grams for all formula components, and where solutions are used the percent concentration is weight by weight.

EXAMPLES 1 –7

A standard ink jet formula containing binder, pigment and polymeric dye fixatives was coated on the felt side of a paper and a solution to improve paper dimensional stability was applied on the back side. The mixtures were coated on bond paper having base weight 105 g/m$^2$ using a Meyer rod #14, and the coated paper was dried at 100° C. for 1.5 minute.

The coating composition for the standard ink jet formulation comprised: 50 g Syloid 72 (oil absorption 200 g/100 g, pore volume 1.2 and average particle size 6.0 microns, supplied by W. R. Grace), 430 g 10% solution of polyvinyl alcohol (Airvol 523 supplied by Air Products), 185 g polyvinyl pyrrolidone K-90 supplied by ISP Technologies, 95 g urethane-acrylic copolymer, 15 g cationic dye fixative Calgon 7091 and 225 g water to make a one liter mixture.

The dimensional stability improving layer or back coat layer was coated from a composition comprising: a water soluble polymer or latex as specified in Table 1 and water in the amount to facilitate coating. Examples 1–3 serve as controls, with Example 1 containing no back coating of a dimensional stability improving layer, and Examples 2–3, respectively, containing back coating of methyl cellulose and latex styrene-butadiene. The dry coat weight of an ink jet layer was 8–10 g/m$^2$. The dry coat weight of the dimensional stability improving layer (and the back coat layer of comparative examples 2 and 3) is as specified in TABLE 1.

The so obtained ink jet recording papers were then tested on large format printers EnCad series particularly Nova Jet PRO and Nova Jet PROe. Printed papers were tested at 23° C. & 50%RH, 38° C. & 90% RH, representing typical southern Florida, USA conditions, and 15° C. & 20% RH, representing typical winter conditions in northern USA states and Canada.

TABLE 1

| | Example | | | | | | |
|---|---|---|---|---|---|---|---|
| | 1 Control | 2 Control | 3 Control | 4 Invention | 5 Invention | 6 Invention | 7 Invention |
| Material | Water | Methyl-cellulose | Latex Styrene-butadiene | PEG 900 | PEG 900 | PEG 1450 | PEG 20M |
| Weight, g/m$^2$ | | 1.5 | 1.5 | 1.5 | 5 | 5 | 5 |
| Paper smoothness | 5 | 3 | 1 | 2 | 2 | 1 | 0 |
| Physical Properties, Curl | | | | | | | |
| 20% RH, 15° C. | +2 | +4 | +3 | +1 | +1 | +1 | +1 |
| 50% RH, 22° C. | 0 | 0 | 0 | 0 | 0 | 0 | 0 |
| 90% RH, 38° C. | −1 | −1 | −2 | 0 | 0 | 0 | 0 |
| Image Quality, 50% RH, 22° C. | | | | | | | |
| Smearing | 3 | 5 | 5 | 5 | 0 | 0 | 0 |
| Surface Streak | 3 | 5 | 5 | 5 | 0 | 0 | 0 |
| Mottle | 1 | 1 | 1 | 2 | 2 | 1 | 1 |
| Bleed | 1 | 1 | 1 | 3 | 1 | 1 | 0 |
| Penetration through | 0 | 0 | 0 | 0 | 0 | 0 | 0 |
| Overall Quality | 5 | 5 | 5 | 5 | 2 | 1 | 1 |
| Image Quality, 90% RH, 38° C. | | | | | | | |
| Mottle | 1 | 1 | 1 | 2 | 2 | 2 | 1 |
| Bleed | 1 | 1 | 1 | 2 | 5 | 2 | 2 |
| Penetration through | 1 | 1 | 1 | 2 | 5 | 3 | 2 |
| Overall Quality | 5 | 5 | 5 | 5 | 5 | 2 | 2 |

In the Tables a (+) sign means curl to the coated side, while a (−) sign means curl to the back side. The properties of coated paper were evaluated on the scale 0–5, where 0 is the best.

Polyethylene glycols PEG 900, 1450 & 20M are supplied by Union Carbide and have trade names: Carbowax 900, 1450 & Compound 20M. Average molecular weight is 900, 1450 & 17,500, respectively.

The coat weight of typical polymers used for curl compensation was in the range of 1.5 g/m$^2$. The use of higher amounts of these polymers made the paper more stiff, which deteriorated print quality. It was found that 5 g/m$^2$ of polyalkylene glycol is generally sufficient to provide dimensional stability of the paper in the broad range of temperatures and humidities.

Table 1 shows that, although polyalkylene glycols having such low. molecular weights (e.g., PEG 900) are sufficient to achieve good dimension stability of paper, nonetheless, the quality of prints made therewith may deteriorate at high temperature and relative humidity due to its migration into the ink receptive layer, but are otherwise acceptable.

EXAMPLES 8 –11

The procedure of Examples 6 was followed using polyethylene glycol having an average molecular weight of 8000. The coat weight of the dimensional stability improving layer was adjusted for each paper to obtain good print quality without imperfections such as penetration through, bleed, smearing and "horseshoes". The dry coat weight of ink jet receiving layer was 8–10 g/m$^2$.

TABLE 2

| | Example | | | |
|---|---|---|---|---|
| | 8 | 9 | 10 | 11 |
| Material | Invention | Invention | Invention | Invention |
| Paper | 105 g/m$^2$ | | 150 g/m$^2$ | |
| Weight, g/m$^2$ | 5 | 10 | 5 | 10 |
| Paper smoothness | 1 | 1 | 1 | 1 |

TABLE 2-continued

| | Example | | | |
|---|---|---|---|---|
| | 8 | 9 | 10 | 11 |
| Image Quality, 50% RH, 22° C. | | | | |
| Smearing | 0 | 0 | 3 | 0 |
| Surface Streak | 0 | 0 | 4 | 0 |
| Mottle | 0 | 0 | 0 | 0 |
| Bleed | 0 | 0 | 0 | 0 |

TABLE 2-continued

| | Example | | | |
|---|---|---|---|---|
| | 8 | 9 | 10 | 11 |
| Penetration through | 0 | 0 | 0 | 0 |
| Overall Quality | 1 | 1 | 4 | 1 |
| Image Quality, 90% RH, 38° C. | | | | |
| Mottle | 1 | 1 | 1 | 1 |
| Bleed | 1 | 1 | 1 | 1 |
| Penetration through | 1 | 3 | 1 | 1 |
| Overall Quality | 1 | 3 | 1 | 1 |

Accordingly, the amount of polyethylene glycol applied in the dimensional stability improving layer is dependent on several factors such as paper base weight, caliper, weight of the ink receptive surface layer. However, polyethylene glycol in an amount of about 5 g/m$^2$ appears sufficient for a paper having a base weight of 105 g/m$^2$ to eliminate any print imperfections such as smearing or horseshoes, with additional amounts of polyethylene glycol deteriorating print quality at high temperature and humidity. On the other hand, a layer of 5 g/m$^2$ of polyethylene glycol does not appear to be sufficient for heavier paper bases. As such, for paper bases of 150 g/m$^2$ the dimensional stability improving layer should be applied in an amount of about 10 g/m$^2$.

EXAMPLES 12–16

In examples 12–18 the ink jet formulation was prepared according to the general procedure set forth for Examples 1–7. Two paper bases 150 g/m$^2$ having different degrees of sizing were used, indicated as Type 1 and Type 2. A solution of polyethylene glycol having an average molecular weight of 8000 was applied as dimensional stability improving layer. Coating conditions were adjusted to the different characteristics of papers.

The sequence of coating had an effect on print quality. If the dimensional stability improving layer is coated after application of the ink jet receiving layer, print quality deteriorates in the form of mottle and "penetration through" at high temperature and humidity. Thus, while this sequence of coating (i.e. ink receiving layer first and then the back coat) is typically used to address a curl problem, the present inventor has found, unexpectedly, however, that good print quality under all circumstances is achieved when a dimensional stability improving layer is applied first and the ink receiving layer is applied second.

TABLE 3

| | Example | | | | |
|---|---|---|---|---|---|
| | 12 | 13 | 14 | 15 | 16 |
| Paper 150 g/sq. m. | Type 1 | | | Type 2 | |
| Coating Technique | Invention Backlayer First | Invention Topcoat First | Invention Backlayer | Invention Underlayer | Invention Backlayer, Underlayer |
| Weight, g/m$^2$ | 5 | 5 | 10 | 10 | 10 |
| Paper smoothness | 1 | 1 | 1 | 1 | 1 |
| Image Quality, 50% RH, 22° C. | | | | | |
| Smearing | 0 | 0 | 1 | 1 | 0 |
| Surface Streak | 0 | 0 | 1 | 2 | 0 |
| Mottle | 0 | 2 | 0 | 0 | 0 |
| Bleed | 0 | 0 | 0 | 0 | 0 |
| Penetration through | 0 | 1 | 0 | 0 | 0 |
| Overall Quality | 1 | 2 | 1 | 2 | 0 |
| Paper 150 g/sq. m. | Type 1 | | | Type 2 | |
| Coating Technique | Invention Backlayer First | Invention Topcoat First | Invention Backlayer | Invention Underlayer | Invention Backlayer, Underlayer |
| Image Quality, 90% RH, 38° C. | | | | | |
| Mottle | 1 | 4 | 1 | 1 | 1 |
| Bleed | 1 | 2 | 1 | 1 | 1 |
| Penetration through | 0 | 2 | 2 | 2 | 1 |
| Overall Quality | 1 | 4 | 2 | 2 | 1 |

The single layer of the dimensional stability improving coating can be applied on the opposite side of the paper support of the ink receptive layer, or as an underlayer underlying the ink receptive layer (Example 15). In some cases, better results are achieved (Example 16) if a dimensional stability improving layer is applied to both sides of the paper support instead of to only one side.

Accordingly, with the present invention, a recording sheet having excellent dimensional stability and good ink absorbability, high color density, good water resistance and high color vividness of images can be obtained. This recording sheet when printed on multicolor printers and plotters (having at least 3 colors) gives images with high color reproducibility to the original colors without encountering print defects typical for wide format printing such as head strikes, smearing and "horseshoes".

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of manufacturing a recording medium having a paper support with a front surface and back surface comprising the following steps, in sequence:

(a) coating the back surface of the paper support with a dimensional stability-improving composition comprising polyalkylene glycol, (b) coating the front surface of the paper support with an underlayer comprising polyalkylene glycol, and (c) coating an ink-receptive composition comprising poly (vinyl alcohol), poly(vinyl pyrrolidone), and particulate onto the underlayer on the front surface of the paper support.

2. The method of claim 1, wherein the polyalkylene glycol is selected from the group consisting of polyethylene glycol, polypropylene glycol, and a copolymer of ethylene oxide and propylene oxide.

3. The method of claim 2, wherein the polyalkylene glycol is polyethylene glycol.

4. The method of claim 1, wherein the dimensional stability-improving composition comprises polyethylene glycol, an acrylic or methacrylic polymer, and a water-soluble polymer.

5. The method of claim 1, wherein the ink-receptive composition comprises silica particulate.

* * * * *